US006312069B1

(12) United States Patent
Weng

(10) Patent No.: US 6,312,069 B1
(45) Date of Patent: Nov. 6, 2001

(54) HEIGHT ADJUSTABLE STRUCTURE OF DESK COMBINATION

(76) Inventor: Teng-Tsai Weng, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/617,421

(22) Filed: Jul. 17, 2000

(51) Int. Cl.[7] ..... A47B 9/00

(52) U.S. Cl. ..... 312/312; 108/147; 248/408

(58) Field of Search ..... 312/277, 299, 312/308, 312, 317.1, 317.2, 317.3, 350; 108/12, 59, 106, 107, 110, 180, 144.11, 147; 248/407, 408, 157

(56) References Cited

U.S. PATENT DOCUMENTS 2,931,685 * 4/1960 Butler ..... 312/312 X
3,744,872 * 11/1973 Morelli ..... 312/312 X
5,549,053 * 8/1996 Grout ..... 108/147
5,598,788 * 2/1997 Jonker ..... 108/147
6,209,840 * 4/2001 Chen ..... 248/407

* cited by examiner

*Primary Examiner*—Jose V. Chen
*Assistant Examiner*—Michael J. Fisher

(57) ABSTRACT

A height adjustable structure of a desk combination includes a drawer cabinet having two sides each provided with a fixed plate, a gear and a pivot arm pivotally mounted on the fixed plate, a torsion spring mounted on the pivot arm so that a mediate portion of the pivot arm is deflected leftward or rightward by the torsion spring, a protective board mounted in an opening defined in the upper portion of the fixed plate, a movable plate slidably mounted on the protective board and having a lower portion defining an elongated successive multiple stepwise locking slot, a rack mounted on one side of the movable plate and meshing with the gear, a support frame secured on a top of the movable plate and engaged with a table face. In such a manner, when the height of the table face is adjusted, the rack of the movable plate is slidable on the gear of the fixed plate. At the same time, the pivot arm is moved along the elongated successive multiple stepwise locking slot to form a snap fixing state by a deflection positioning action of the pivot arm.

1 Claim, 6 Drawing Sheets

HEIGHT ADJUSTABLE STRUCTURE OF DESK COMBINATION

BACKGROUND OF THE INVENTION

1. Field of the Invention

The present invention relates to a height adjustable structure of a desk combination. Especially, the drawer cabinet of the desk combination can be used for adjusting the height of the table face to a proper position.

2. Description of the Related Art

A conventional desk combination in accordance with the prior art comprises a desk, and a drawer cabinet. The drawer cabinet can be received in the right side, the left side or the two sides of the desk, and can also be used individually so that the desk and the drawer cabinet co-operate with each other so as to form a diverse combination, thereby increasing the versatility of the desk combination. However, the drawer cabinet includes a table face which is usually fixed on the drawer cabinet so that the height of the table face of the drawer cabinet cannot be adjusted arbitrarily to fit users of different statures, thereby greatly limiting the versatility of the drawer cabinet.

SUMMARY OF THE INVENTION

In accordance with one aspect of the present invention, there is provided a height adjustable structure of a desk combination comprising a drawer cabinet having two sides each provided with a fixed plate, a gear pivotally mounted on an upper portion of the fixed plate, a pivot arm pivotally mounted on a lower portion of the fixed plate, a torsion spring mounted on the pivot arm so that a mediate portion of the pivot arm is deflected leftward or rightward by an elastic action of the torsion spring, the lower portion of the fixed plate having two sides each provided with a track, a protective board mounted in an opening defined in the upper portion of the fixed plate, a movable plate slidably mounted on the protective board and having a lower portion defining an elongated successive multiple stepwise locking slot, a rack mounted on one side of the movable plate and meshing with the gear, a support frame secured on a top of the movable plate and engaged with a table face, wherein, when the height of the table face is adjusted, the rack of the movable plate is slidable on the gear of the fixed plate, at the same time, the pivot arm is moved along the elongated successive multiple stepwise locking slot to form a snap fixing state by a deflection positioning action of the pivot arm, and a lower portion of the locking slot of the movable plate having a catch body and a hollow portion across connected to two sides of the locking slot, thereby increasing a structural strength of the catch body and the hollow portion, and thereby efficiently preventing the catch body and the hollow portion from being deformed.

Further benefits and advantages of the present invention will become apparent after a careful reading of the detailed description with appropriate reference to the accompanying drawings.

DETAILED DESCRIPTION OF THE INVENTION

Figure 6:
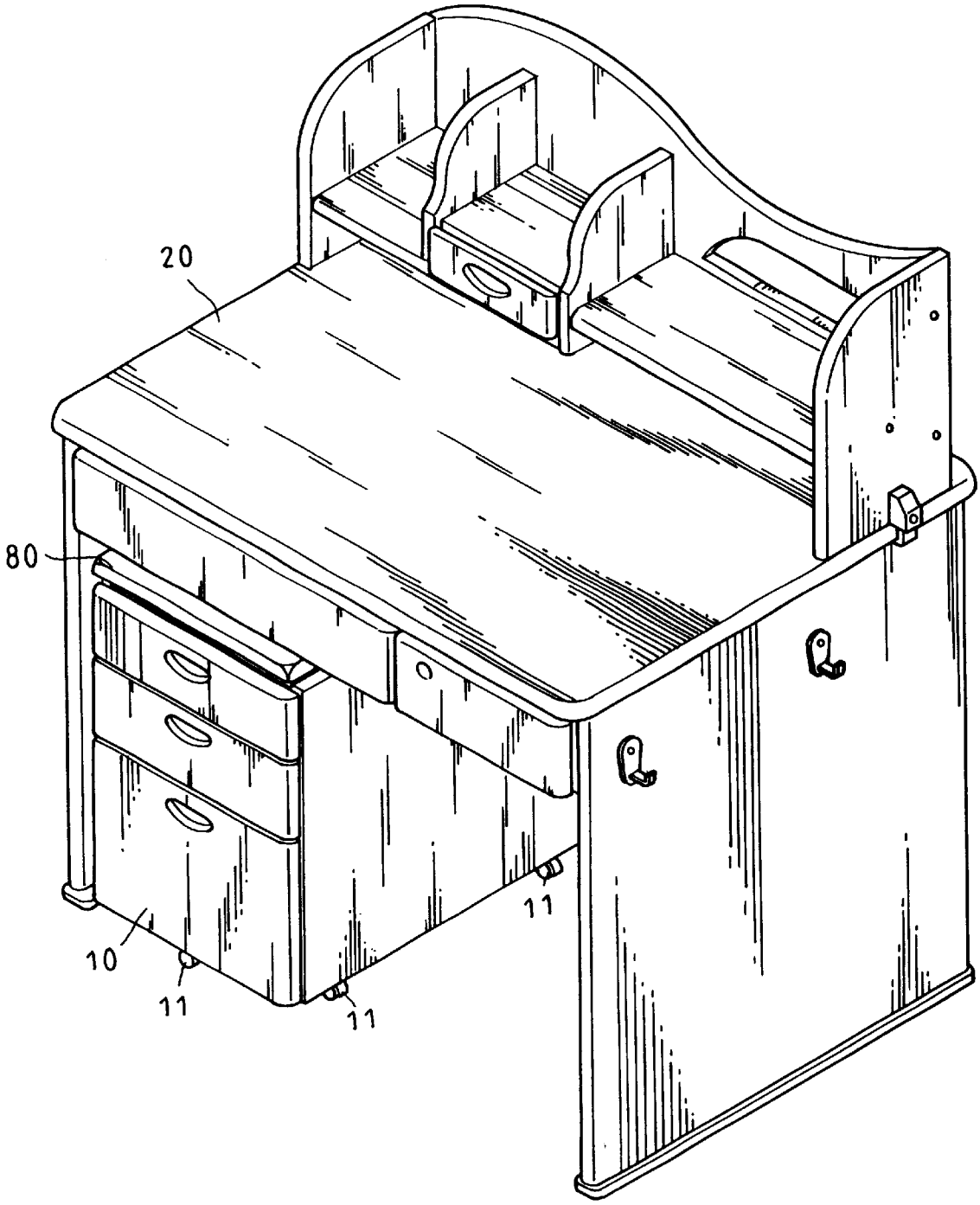
FIG. 6 is a perspective view showing the height adjustable structure being attached to the desk combination.

Referring to FIGS. 1–6, the height adjustable structure for a desk combination 20 in accordance with the present invention comprises a drawer cabinet 10 having two sides each defining a receiving chamber 12 for securing a fixed plate 30 and a protective board 40 and having a bottom provided with a plurality of rollers 11 for facilitating the drawer cabinet 10 moving in the desk combination 20 as shown in FIG. 6.

The fixed plate 30 has two sides each defining a plurality of holes 31 so that the fixed plate 30 and the protective board 40 can be secured in the receiving chamber 12 by means of a plurality of screws "P". The protective board 40 is mounted in an opening 32 defined in the upper portion of the fixed plate 30. An elongated movable plate 50 is slidably mounted on the protective board 40. A support frame 70 is secured on the top of the movable plate 50 and engaged with a table face 80, the height of the table face 80 can be adjusted.

A gear 35 is pivotally mounted on a through hole 33 defined in the upper portion of the fixed plate 30, and a pivot arm 60 is pivotally mounted on a through hole 34 defined in the lower portion of the fixed plate 30.

The pivot arm 60 has an upper end defining a circular hole 61 for securing an axle 63, a mediate portion defining a through hole 65 for securing a torsion spring "S", and a lower end defining a circular hole 62 for securing an axle 64. The torsion spring "S" includes a first leg "S1" secured in the through hole 65 of the pivot arm 60, and a second leg "S2" secured on the axle 36 which is secured on the bottom of the fixed plate 30. In such a manner, the mediate portion of the pivot arm 60 is deflected leftward or rightward by the elastic action of the torsion spring "S".

The lower portion of the fixed plate 30 has two sides each provided with an L-shaped track 37 for limiting and guiding movement of the movable plate 50.

The movable plate 50 has a lower portion defining an elongated successive multiple stepwise locking slot 51, and a rack 52 meshing with the gear 35 is securely mounted on one side of the movable plate 50 by means of a plurality of screws "P". In such a manner, the rack 52 of the movable plate 50 is slidable on the gear 35 of the fixed plate 30.

At the same time, the axle 63 on the upper portion of the pivot arm 60 is received in the elongated successive multiple stepwise locking slot 51 whereby the axle 63 of the pivot arm 60 can be deflected leftward to be snap positioned in the elongated successive multiple stepwise locking slot 51 by the deflection positioning action of the pivot arm 60.

The lowermost portion of the locking slot 51 of the movable plate 50 includes a catch body 53 and a hollow portion 54 across connected to two sides of the locking slot 51. In such a manner, when the axle 63 of the pivot arm 60 touches the catch body 53, the axle 63 of the pivot arm 60 is deflected leftward to be positioned in the lowermost portion of the elongated successive multiple stepwise locking slot 51 by the deflection positioning action of the pivot arm 60. Finally, when the axle 63 of the pivot arm 60 passes through the catch body 53 and the hollow portion 54, the pivot arm 60 will return to the original state to deflect rightward.

Figure 1:
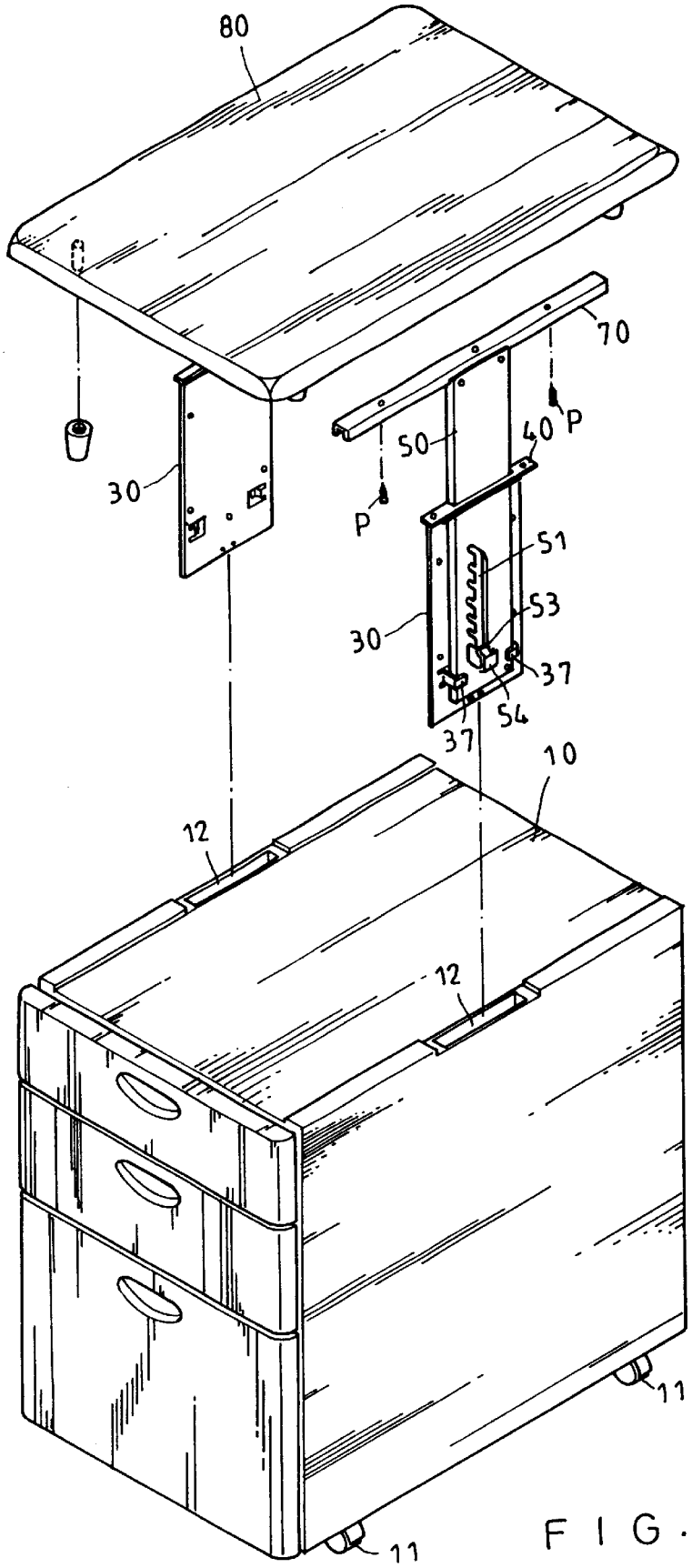
FIG. 1 is an exploded view of a height adjustable structure for a desk combination in accordance with the present invention.
Figure 2:
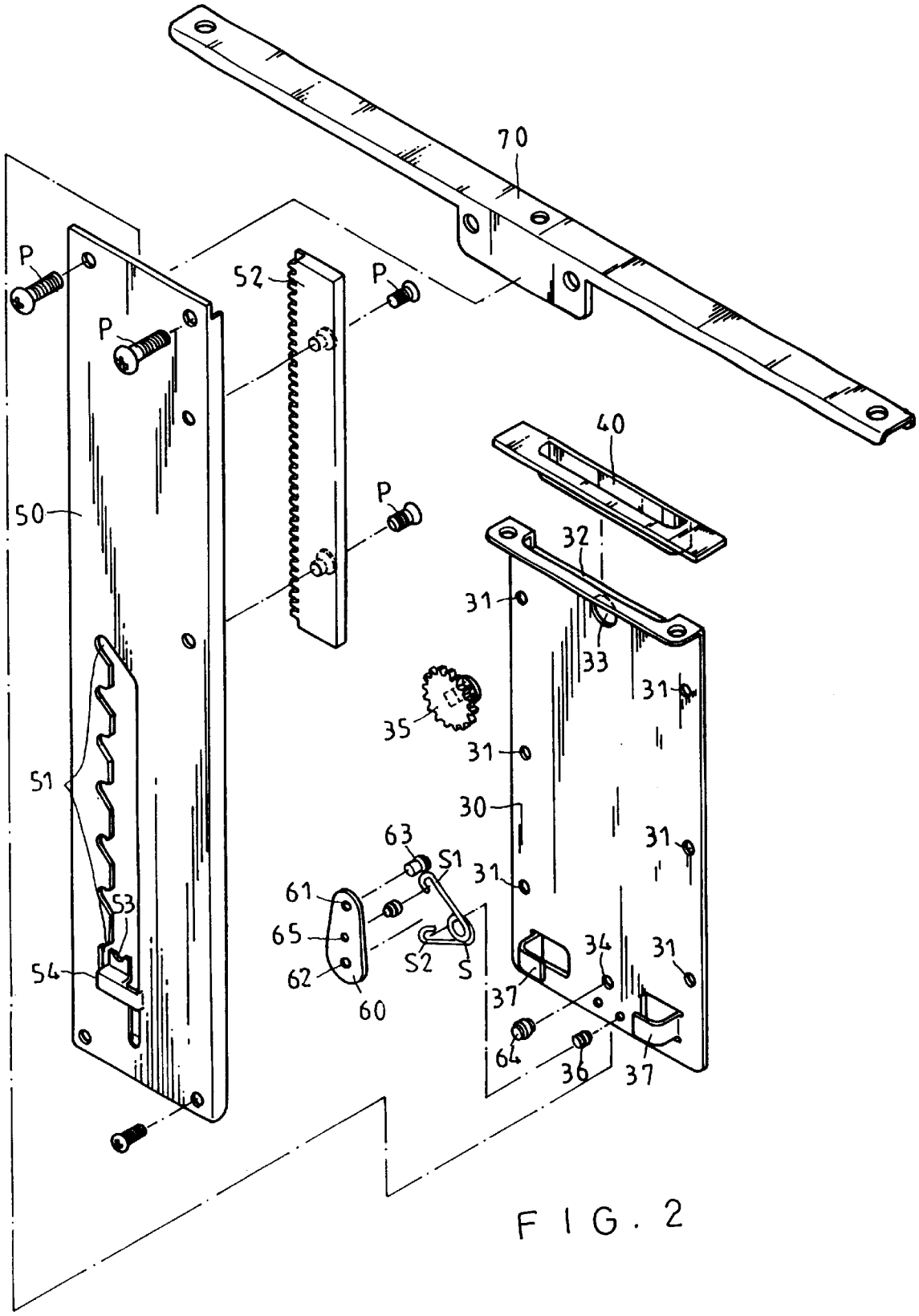
FIG. 2 is an exploded view of the height adjustable structure for a desk combination as shown in FIG. 1.
Figure 3:
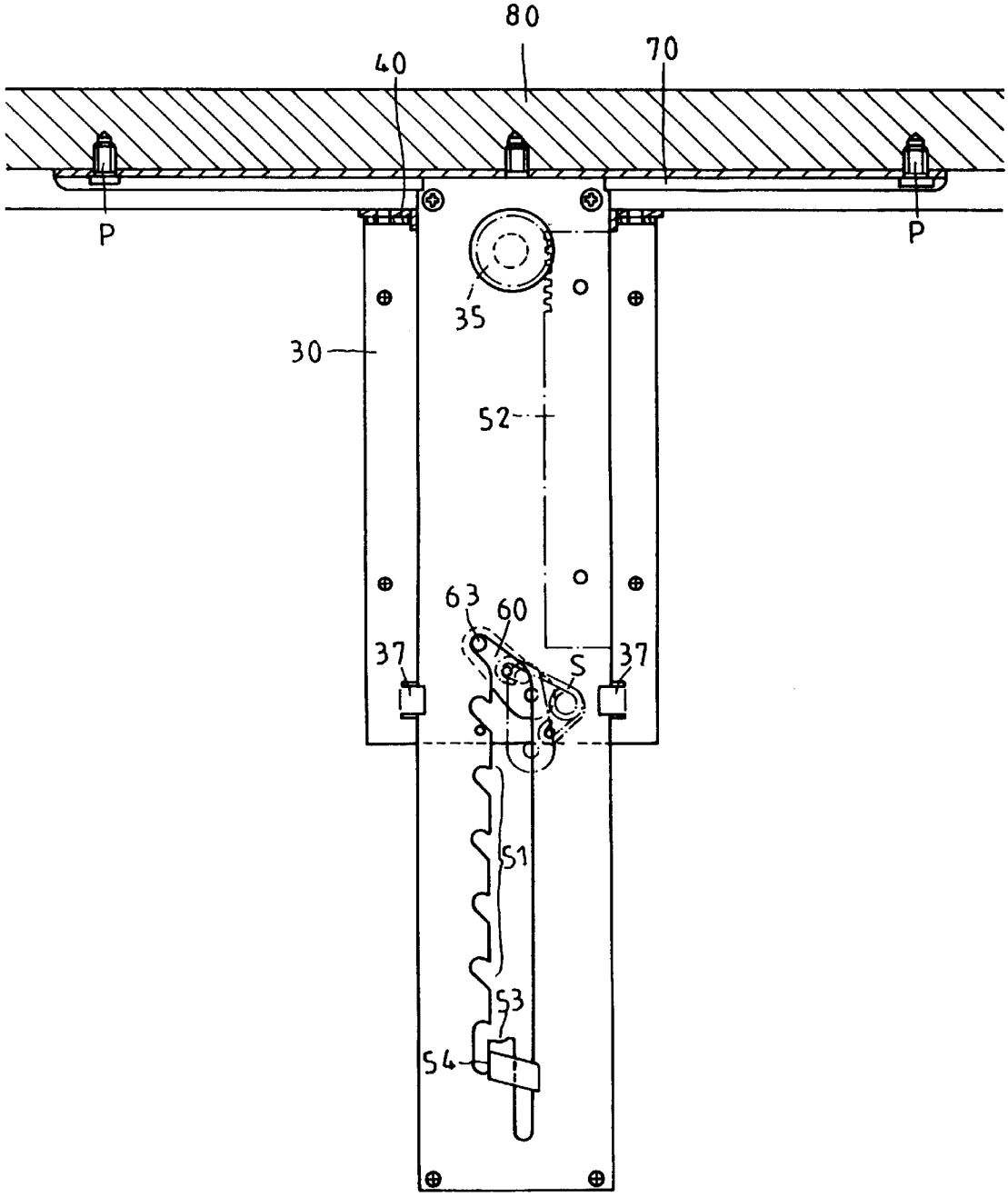
FIG. 3 is a front plan cross-sectional assembly view of the height adjustable structure for a desk combination as shown in FIG. 2.
Figure 4:
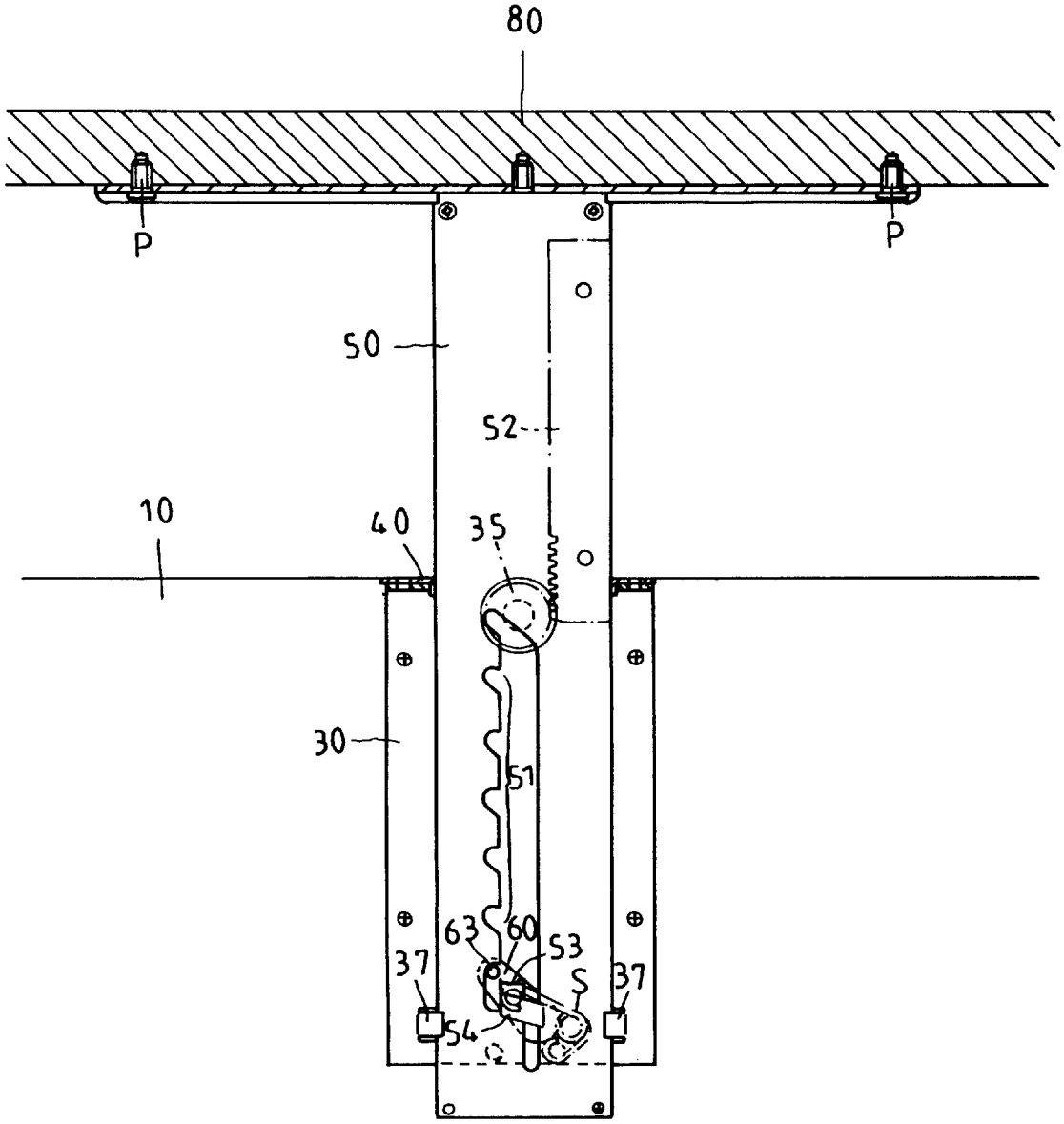
FIG. 4 is an operational view of the height adjustable structure for a desk combination as shown in FIG. 3 in use.
Figure 5:
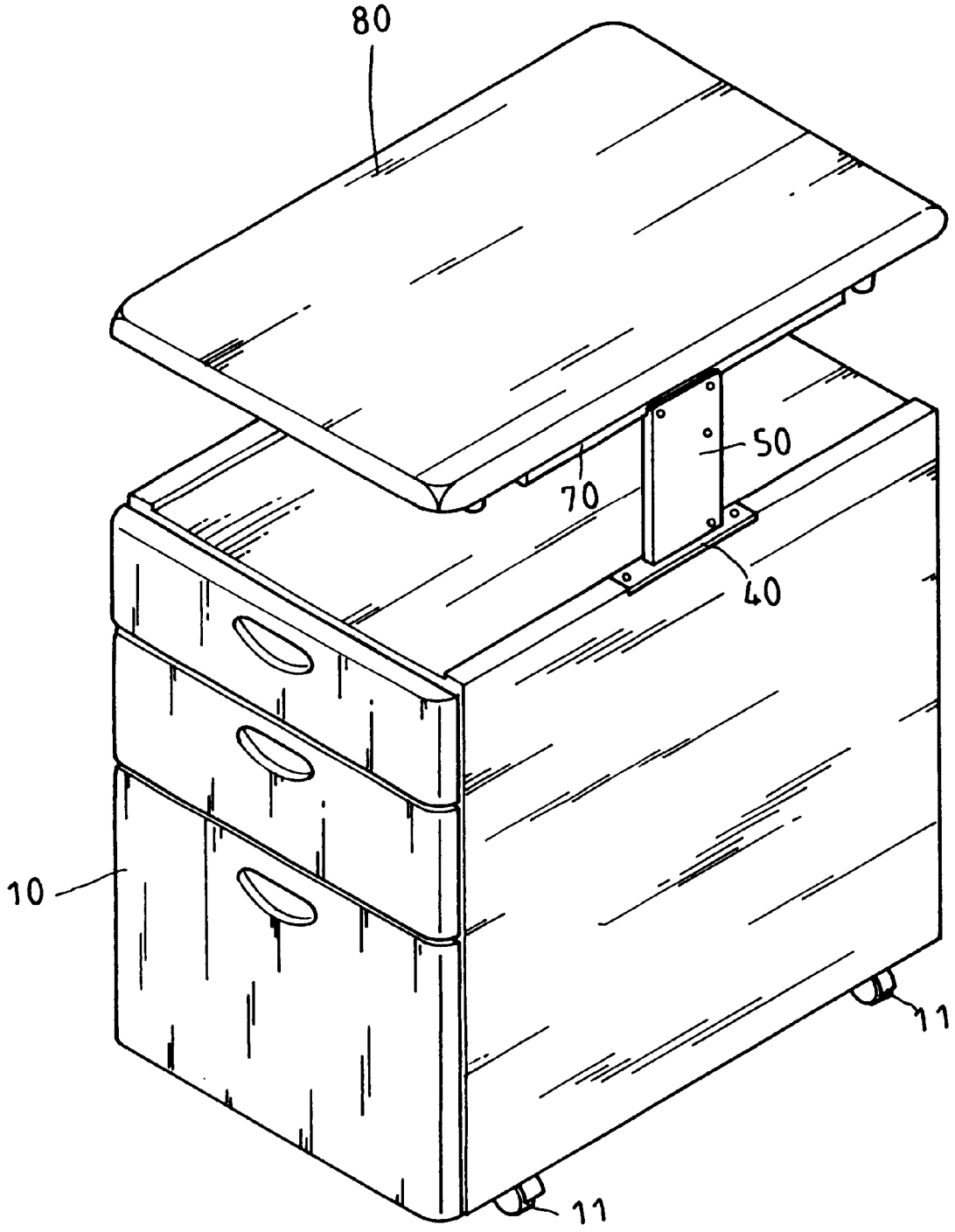
FIG. 5 is,a perspective assembly view of the height adjustable structure for a desk combination as shown in FIG. 1.

In operation, referring to FIGS. 3 and 4, the pivot arm 60 can only be deflected leftward or rightward by the elastic action of the torsion spring "S". when the table face 80 is lifted, the axle 63 on the upper portion of the pivot arm 60 is moved downward in the elongated successive multiple stepwise locking slot 51, and is stepwise snap positioned in the elongated successive multiple stepwise locking slot 51.

When the table face 80 is adjusted to its uppermost position, the axle 63 of the pivot arm 60 is deflected leftward to be positioned in the lowermost portion of the elongated successive multiple stepwise locking slot 51 after the axle 63 touches the catch body 53.

When the user wishes to adjust the table face 80 to its lowermost position or to readjust the height of the table face 80, he only needs to lift the table face 80 again so that the axle 63 of the pivot arm 60 passes through the hollow portion 54 of the catch body 53, thereby returning it to the original state to deflect rightward so that the axle 63 of the pivot arm 60 can be moved to the uppermost portion of the elongated successive multiple stepwise locking slot 51.

In addition, the rack 52 of the movable plate 50 meshes with the gear 35 of the fixed plate 30 so that the user can easily operate them for adjusting the height of the table face 80, thereby greatly increasing the versatility of the desk combination 20.

It should be clear to those skilled in the art that further embodiments may be made without departing from the scope of the present invention.

What is claimed is:

1. A height adjustable structure of a desk combination comprising a drawer cabinet (10) having two sides each provided with a fixed plate (30), a gear (35) pivotally mounted on an upper portion of said fixed plate (30), a pivot arm (60) pivotally mounted on a lower portion of said fixed plate (30), a torsion spring (S) mounted on said pivot arm (60) so that a mediate portion of said pivot arm (60) is deflected leftward or rightward by an elastic action of said torsion spring (S), said lower portion of said fixed plate (30) having two sides each provided with a track (37), a protective board (40) mounted in an opening (32) defined in said upper portion of said fixed plate (30), a movable plate (50) slidably mounted on said protective board (40) and having a lower portion defining an elongated successive multiple stepwise locking slot (51), a rack (52) mounted on one side of said movable plate (50) and meshing with said gear (35), a support frame (70) secured on a top of said movable plate (50) and engaged with a table face (80), wherein, when the height of the table face (80) is adjusted, said rack (52) of said movable plate (50) is slidable on said gear (35) of said fixed plate (30), at the same time, said pivot arm (60) is moved along said elongated successive multiple stepwise locking slot (51) to form a snap fixing state by a deflection positioning action of said pivot arm (60), and a lower portion of said locking slot (51) of said movable plate (50) having a catch body (53) and a hollow portion (54) across connected to two sides of said locking slot (51), thereby increasing a structural strength of said catch body (53) and said hollow portion (54), and thereby preventing said catch body (53) and said hollow portion (54) from being deformed.

* * * * *